United States Patent [19]

Bacoka

[11] 4,165,895

[45] Aug. 28, 1979

[54] PICKUP DEVICE FOR DOG DROPPINGS

[76] Inventor: Josip Bacoka, Winkelriedstrasse 33, St. Gallen, Switzerland

[21] Appl. No.: 810,802

[22] Filed: Jun. 28, 1977

[30] Foreign Application Priority Data

Jun. 30, 1976 [DE] Fed. Rep. of Germany ..... 2629342

[51] Int. Cl.[2] ..... A01K 29/00; A47L 13/52

[52] U.S. Cl. ..... 294/19 R; 15/257.1; 294/1 R; 294/53.5

[58] Field of Search ..... 294/1 R, 2, 19 R, 24, 294/51, 53.5, 55; 15/104.8, 257.1, 257.2, 257.4, 257.7; 135/66, 74

[56] References Cited

U.S. PATENT DOCUMENTS

| | | | |
|---|---|---|---|
| 1,336,638 | 4/1920 | Kutwicz | 135/74 |
| 2,849,743 | 9/1958 | McFarland | 15/257.2 |
| 3,026,553 | 3/1962 | Whitmire | 15/257.4 X |
| 3,456,663 | 7/1969 | Blum | 294/53.5 X |
| 3,819,220 | 6/1974 | Bredt | 294/19 R |
| 3,827,098 | 8/1974 | Sanderson | 15/257.4 X |
| 3,977,422 | 8/1976 | Cabaluna | 294/19 R X |
| 4,005,892 | 2/1977 | Williams | 294/1 R |

*Primary Examiner*—Johnny D. Cherry
*Attorney, Agent, or Firm*—Hoffman Stone

[57] ABSTRACT

A walking cane with a bag holder pivoted near its lower end, and a paddle-like shovel removably secured to the cane and operative when in its secured position to hold the bag holder in a retracted position with a bag held by the holder raised above the bottom of the cane.

3 Claims, 2 Drawing Figures

PICKUP DEVICE FOR DOG DROPPINGS

BRIEF DESCRIPTION

This invention relates to a manual device for picking up dog droppings intended especially for use by dog owners. When walking his dog the owner can conveniently immediately remove the droppings from public areas.

Dog owners living in apartment dwellings who do not have a garden or a similar area at their disposal have to take their dogs out on the street or on the sidewalks. This causes undesirable and unhygienic conditions which are a nuisance to other citizens and an embarrassment to the dog owner.

There does not appear to be a device presently available that makes it possible for dog owners conveniently to remove dog droppings while walking their dogs.

The present invention enables the immediate removal of dog droppings with a minimum of inconvenience because each dog owner can take a pickup device along while walking his dog and when necessary may retrieve immediately the droppings at location and carry them home without danger of soiling.

DETAILED DESCRIPTION

Figure 1:
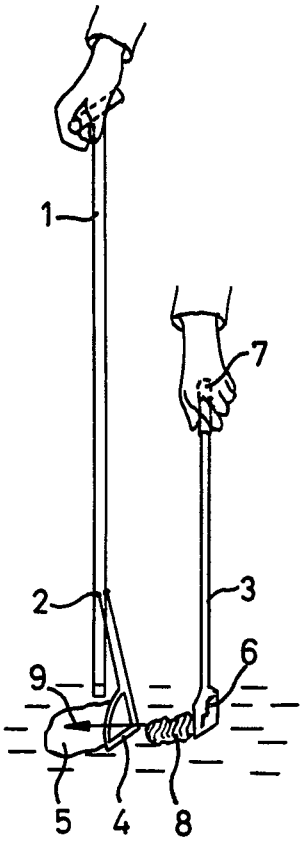
Figure 2:
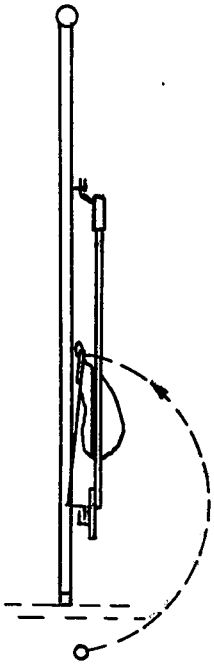

A presently preferred embodiment of the invention will now be described in conjunction with the drawing, wherein:

FIG. 1 is a side elevational view of the pickup device in its extended position for retrieving; and FIG. 2 is a side elevational view of the device in its retracted, or strolling position.

The pickup device of the invention is a walking cane 1 with a chamber attachment at its lower end arranged to receive the dog droppings when in a lowered position, and to be retracted upwardly thereafter and retained in an upper position above the bottom of the cane.

The chamber attachment includes a frame 4 pivoted on the cane 1, and a receiving bag 5 removably secured to the frame. A paddle-like pickup shovel 3 is releasably secured by a set of hooks 6 and 7 to the cane 1. When hooked in its secured position the shovel is on the opposite side of the chamber attachment from the cane and serves to hold the chamber attachment in its retracted position and the droppings in the bag. The cane may readily be made foldable so that it may be folded to a shorter length for convenience in carrying or packing.

The device is typically operated as follows: Before use an empty receiving bag is inserted and fastened in the frame 4, which is then pivoted to its upper, retracted position. The shovel 3 is hooked up, top and bottom, and keeps the chamber attachment in its retracted position, pressing the bag against the shaft of the cane. The bag 3 is held against the shaft of the cane and prevented from swinging downward or discharging its contents while walking the dog.

When walking the dog the shovel 3 is removed from the cane 1 to pick up the droppings. The chamber attachment pivots downward and is hooked in position to receive the dropping, which is pushed into the bag by the shovel. Thereafter, the chamber attachment is retracted with the aid of the shovel or the hook 6 at its end. Fastening the shovel at top and bottom to the cane retains the chamber attachment in its retracted position. The droppings are hygienically stored in the bag.

The device may be used as a simple walking cane when strolling continues. If the cane is also made foldable it may be reduced in size and placed inside a wrapper. At the proper location the bag may be removed from the frame and emptied or discarded. A new bag may then be inserted into the frame and the device is ready for the next usage.

FIG. 1 shows the pickup device with the chamber attachment in its lowered position ready to accept the droppings 8. The frame 4 is fastened to the cane 1 by a pivot 2. The receiving bag 5 is attached to the frame 4 by any convenient means. The shovel 3 is provided with a hook 6 and a loop 7. The dropping 8 is pushed by the shovel in the direction indicated by the arrow 9 into the bag 5.

FIG. 2 shows the device after the dropping pickup, with the chamber attachment in its retracted position, and the shovel pressing against the receiving bag. In this position the device serves as a walking cane.

What is claimed is:

1. A device for conveniently picking up dog droppings comprising a walking cane, a bag holding device pivotally secured to the cane near the lower end thereof and swingable between an extended position in which a bag held by it lies in a generally horizontal position with its open end in a generally vertical plane and the bottom of its open end below the bottom of the cane and a retracted position in which the entire bag is held above the bottom of the cane, said holding device including a collar that grips and holds open the open end of the bag leaving the rest of the bag otherwise unsupported so that when the device is in its retracted position a bag held by it is at least partly closed by a wall portion of the bag.

2. A device according to claim 1 including also a shovel, and means for releasably securing said shovel to the cane with the bag holding device together with a bag held by it between the shovel and the cane, thereby releasably retaining the bag holder in its retracted position.

3. A device according to claim 1 in which a bag is readily removable from the bag holding device for emptying or disposal.

* * * * *